US011758939B2

(12) United States Patent
Bundren et al.

(10) Patent No.: US 11,758,939 B2
(45) Date of Patent: Sep. 19, 2023

(54) MEDIUM DPF AND TOTAL DENIER CELLULOSE ACETATE TOW

(71) Applicant: ACETATE INTERNATIONAL LLC, Irving, TX (US)

(72) Inventors: Christopher M. Bundren, Blacksburg, VA (US); Austin Banks, Blacksburg, VA (US); William Sanderson, Blacksburg, VA (US); Philip Caenen, Lanaken (BE); Christophe Loix, Gelik (BE)

(73) Assignee: ACETATE INTERNATIONAL LLC, Irving, TX (US)

( * ) Notice: Subject to any disclaimer, the term of this patent is extended or adjusted under 35 U.S.C. 154(b) by 244 days.

(21) Appl. No.: 17/211,431

(22) Filed: Mar. 24, 2021

(65) Prior Publication Data

US 2021/0298351 A1 Sep. 30, 2021

Related U.S. Application Data

(60) Provisional application No. 62/994,056, filed on Mar. 24, 2020.

(51) Int. Cl.

| | |
|---|---|
| ***A24D 3/04*** | (2006.01) |
| ***A24D 3/17*** | (2020.01) |
| ***A24D 1/20*** | (2020.01) |
| ***A24D 3/06*** | (2006.01) |
| ***A24D 3/10*** | (2006.01) |
| ***D01D 5/253*** | (2006.01) |

(52) U.S. Cl.
CPC ..... *A24D 3/17* (2020.01); *A24D 1/20* (2020.01); *A24D 3/064* (2013.01); *A24D 3/10* (2013.01); *D01D 5/253* (2013.01); *D10B 2201/28* (2013.01); *D10B 2505/04* (2013.01)

(58) Field of Classification Search
CPC . A24D 1/20; A24D 3/04; A24D 3/062; A24D 3/063; A24D 3/064; D01D 5/253; D10B 2201/28; D10B 2505/04; D01F 2/28
See application file for complete search history.

(56) References Cited

U.S. PATENT DOCUMENTS

| | | | |
|---|---|---|---|
| 2,740,775 A | 4/1956 | Karrer et al. | |
| 4,819,665 A | 4/1989 | Roberts et al. | |
| 5,499,636 A | 3/1996 | Baggett, Jr. et al. | |

(Continued)

FOREIGN PATENT DOCUMENTS

| | | | | |
|---|---|---|---|---|
| CN | 1954103 A * | 4/2007 | ..... | D01F 2/28 |
| JP | 2019070217 A | 5/2019 | | |

(Continued)

OTHER PUBLICATIONS

International Search Report and Written Opinion for PCT/US2021/023951 dated Jun. 23, 2021, all pages.

(Continued)

*Primary Examiner* — Eric Yaary
(74) *Attorney, Agent, or Firm* — Kilpatrick Townsend & Stockton LLP

(57) ABSTRACT

Disclosed are cellulose acetate tows, bales, and filter rods having from greater than 9 to less than 12.5 denier per filament and from 20,000 to 40,000 total denier, for use in smoking devices, including aerosol-generating devices such as an electrically heated cigarette.

16 Claims, 2 Drawing Sheets

(56) References Cited

U.S. PATENT DOCUMENTS

| | | | | |
|---|---|---|---|---|
| 5,947,126 | A * | 9/1999 | Wilson | A24D 3/10 131/345 |
| 6,026,820 | A | 2/2000 | Baggett, Jr. et al. | |
| 6,924,029 | B1 * | 8/2005 | Caenen | A24D 3/0204 131/331 |
| 7,585,441 | B2 | 9/2009 | Caenen et al. | |
| 7,610,852 | B2 | 11/2009 | Bundren et al. | |
| 8,881,737 | B2 | 11/2014 | Collett et al. | |
| 8,910,640 | B2 | 12/2014 | Sears et al. | |
| 9,597,466 | B2 | 3/2017 | Henry, Jr. et al. | |
| 2005/0172976 | A1 | 8/2005 | Newman et al. | |
| 2013/0096297 | A1 | 4/2013 | Combs et al. | |
| 2014/0026911 | A1 * | 1/2014 | Bundren | A24D 3/064 493/46 |
| 2015/0027474 | A1 | 1/2015 | Zuber et al. | |
| 2016/0309782 | A1 | 10/2016 | Malgat et al. | |
| 2017/0055580 | A1 | 3/2017 | Blandino et al. | |
| 2021/0112855 | A1 * | 4/2021 | Watanabe | A24B 15/28 |
| 2021/0251282 | A1 * | 8/2021 | Miyashita | A24C 5/01 |

FOREIGN PATENT DOCUMENTS

| | | | |
|---|---|---|---|
| KR | 102058838 | B1 | 12/2019 |
| WO | 2018/224679 | A1 | 12/2018 |
| WO | 2019/165084 | A1 | 8/2019 |

OTHER PUBLICATIONS

International Preliminary Report on Patentability for PCT/US2021/023951 dated Sep. 22, 2022, all pages.

Official Notification issued by the Eurasian Patent Office dated Jan. 25, 2023 for Appln No. 202292691 (PCT/US2021/023951), all pages.

* cited by examiner

MEDIUM DPF AND TOTAL DENIER CELLULOSE ACETATE TOW

CROSS-REFERENCE TO RELATED APPLICATION

This application claims priority to Provisional Application No. 62/994,056, filed on Mar. 24, 2020, the entire contents and disclosure of which are hereby incorporated by reference.

FIELD OF THE INVENTION

The present disclosure relates generally to cellulose acetate tow having a specific denier per filament and total denier, and to the use of such tow in smoke devices. In particular, the present disclosure relates to cellulose acetate tow comprising from greater than 9 to less than 12.5 denier per filament and from 20,000 to 40,000 total denier, for use in smoking devices, including an aerosol-generating device.

BACKGROUND OF THE INVENTION

Cellulose esters, such as cellulose acetate, are known for their use in traditional cigarette filters and other smoking articles, such as aerosol-generating devices. Aerosol-generating devices provide a smoker with an aerosol which is similar to tobacco smoke, such as by heating the aerosol generating means with a fuel source, e.g., tobacco. The tobacco is sufficiently heated or burned to vaporize the nicotine and produce an aerosol stream containing nicotine. The smoking article may have an outer cylinder of fuel with good smoldering characteristics, preferably cut tobacco or reconstituted tobacco, surrounding a metal tube containing tobacco, reconstituted tobacco or other source of nicotine and water vapor. In other aerosol-generating devices, an inhalable aerosol is generated by the transfer of heat from a heat source to a physically separate aerosol-forming substrate or material, which may be located within, around or upstream from the heat source. During consumption of the aerosol-generating article, volatile compounds are released by heat transfer from the heat source and entrained in air drawn through the aerosol-generating article. As the released compounds cool by passing through a cooling element, they condense to form an aerosol that is inhaled by the user.

As with traditional smoking devices, a filter is included in aerosol-generating devices. Also as with traditional smoking devices, the filter is typically formed from cellulose ester tow, e.g., cellulose acetate tow. The cellulose ester tow supplied to filter manufacturers as cellulose ester tow is manufactured to meet certain properties required for cigarette filters, such as a firmness, pressure drop, pressure drop variability, fly, and openability, with a goal being a cigarette with acceptable draw resistance. Methods of making cellulose ester tow continue to be refined to improve the properties of the tow for use in cigarette filters.

KR Patent 102058838 discloses a cellulose acetate tow band having 10,000 to 40,000 total denier, 6.0 to 20.0 denier per filament, for use in an electronic cigarette tip. JP Patent Application No. 2019070217 discloses a tow band for electronic cigarettes. The application claims a tow band of cellulose acetate in which a plurality of filaments are bundled and crimped, and the total denier is set to a value in the range of 23,000 to 40,000 and the filament denier is 7.0 or more.

Therefore, among other things, a need exists for cellulose acetate tow for forming filters with desired pressure drop, firmness, size and filtration characteristics, as well as to tow than can be processed into filter rods without issue at high speeds.

SUMMARY OF THE INVENTION

In some embodiments, the present disclosure is directed to an aerosol-generating device comprising: an aerosol-generating article, wherein the aerosol-generating article comprises: an aerosol-forming substrate; a support element; an aerosol-cooling element; and a mouthpiece, wherein the mouthpiece comprises a cellulose acetate tow rod having from greater than 9 to less than 12.5 denier per filament and from 20,000 to 40,000 total denier. The cellulose acetate tow rod may have an encapsulated pressure drop of 2.0 mm water/mm length or less. The cellulose acetate tow rod may have a circumference from 18 to 26 mm. The aerosol-generating device may maintain an aerosol temperature of 250 to 350° C. The cellulose acetate tow rod may have a hardness of at least 85%. The cellulose acetate tow rod may have from 24,000 to 35,000 total denier. The cellulose acetate tow rod may have from 24,000 to 30,000 total denier. The cellulose acetate tow rod may have from 10 to less than 12.5 denier per filament. The cellulose acetate tow rod may have from 11.5 to 12.3 denier per filament. The cellulose acetate tow rod may have approximately 12 denier per filament and from 25,000 to 28,000 total denier. The filaments of the cellulose acetate tow rod may have a cross-sectional shape selected from the group comprising circular, substantially circular, crenulated, ovular, substantially ovular, polygonal, substantially polygonal, dog-bone, "Y," "X," "K," "C," multi-lobe, and any combination thereof. The cellulose acetate tow may have a denier per filament percent coefficient of variability of less than 15%, less than 12%, less than 10%, less than 8%, less than 6%, or less than 4%.

In some embodiments, the present disclosure is directed to a tow band comprising cellulose acetate tow having from greater than 9 to less than 12.5 denier per filament and from 20,000 to 40,000 total denier. The cellulose acetate tow rod may have from 24,000 to 35,000 total denier. The cellulose acetate tow rod may have from 24,000 to 30,000 total denier. The cellulose acetate tow rod may have from 10 to less than 12.5 denier per filament. The cellulose acetate tow rod may have from 11.5 to 12.3 denier per filament. The cellulose acetate tow rod may have s approximately 12 denier per filament and from 25,000 to 28,000 total denier. The filaments of cellulose acetate tow rod may have a cross-sectional shape selected from the group comprising circular, substantially circular, crenulated, ovular, substantially ovular, polygonal, substantially polygonal, dog-bone, "Y," "X," "K," "C," multi-lobe, and any combination thereof. The cellulose acetate tow may have a denier per filament percent coefficient of variability of less than 15%, less than 12%, less than 10%, most less than 8%, less than 6%, or less than 4%.

In some aspects, the present disclosure is directed to a method of forming a mouthpiece for an aerosol-generating device, the method comprising: forming a bale from a tow band having from greater than 9 to less than 12.5 denier per filament and from 20,000 to 40,000 total denier, the tow band comprising a plurality of cellulose acetate filaments; debaling and opening the tow band to form a filter tow; forming a mouthpiece comprising a filter rod from the filter tow. The cellulose acetate tow rod may have an encapsulated pressure drop of 2.0 mm water/mm length or less. The cellulose acetate tow rod may have a circumference from 18 to 26 mm. The aerosol-generating device may maintains an aerosol temperature of 250 to 350° C. The cellulose acetate tow rod may have a hardness of at least 85%. The cellulose acetate tow rod may have from 24,000 to 35,000 total denier. The cellulose acetate tow rod may have from 24,000 to 30,000 total denier. The cellulose acetate tow rod may have from 10 to less than 12.5 denier per filament. The cellulose acetate tow rod may have from 11.5 to 12.3 denier per filament. The cellulose acetate tow rod may have approximately 12 denier per filament and from 25,000 to 28,000 total denier. The filaments of the cellulose acetate tow rod may have a cross-sectional shape selected from the group comprising circular, substantially circular, crenulated, ovular, substantially ovular, polygonal, substantially polygonal, dog-bone, "Y," "X," "K," "C," multi-lobe, and any combination thereof. The cellulose acetate tow may have a denier per filament percent coefficient of variability of less than 15%, less than 12%, less than 10%, less than 8%, less than 6%, or less than 4%.

BRIEF DESCRIPTION OF THE DRAWINGS

The present invention will be better understood in view of the appended non-limiting figures, in which.

DETAILED DESCRIPTION OF THE INVENTION

Introduction

Figure 1:
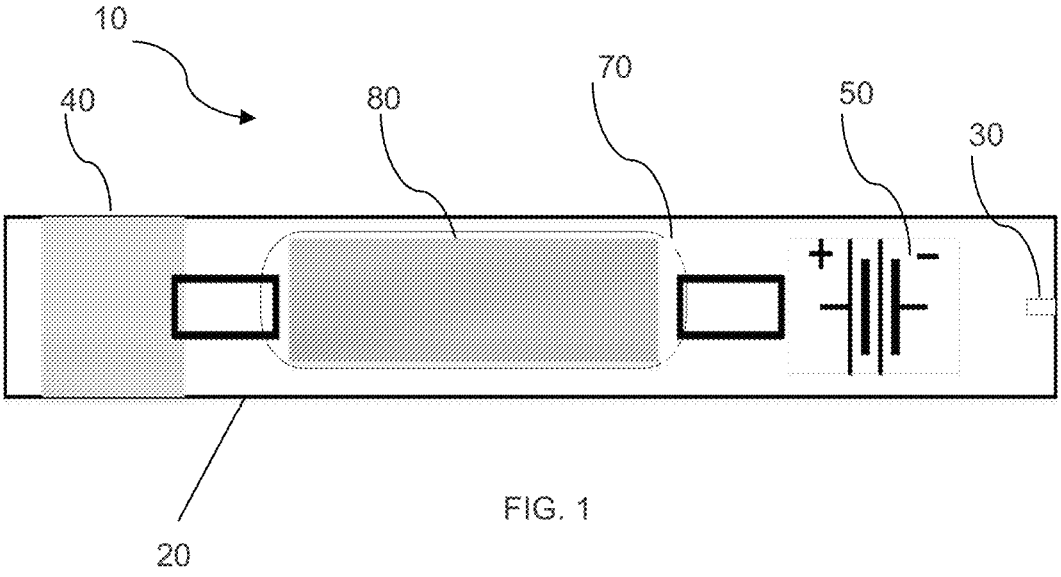
FIG. 1 shows a cross-sectional view of an aerosol-generating article in accordance with embodiments of the present invention.

The present disclosure is directed to cellulose acetate tow having medium range denier per filament and total denier, e.g., from greater than 9 to less than 12.5 dpf and from 20,000 to 40,000 total denier. The tow may be used to form tow bands, tow bales, and filters or mouthpieces for smoking devices, such as aerosol-generating devices or devices intended for smoking cannabis. As used herein, an aerosol-generating device does not refer to a conventional cigarette.

Aerosol-generating devices described herein may comprise an aerosol-forming substrate, a support element, and aerosol-cooling element, and a mouthpiece. The mouthpiece may be formed from a cellulose acetate tow rod having >9 and <12.5 denier per filament and from 20,000 to 40,000 total denier. The mouthpiece of the aerosol-generating device has a low encapsulated pressure drop, as well as desirable firmness, delivery of the aerosol at a desirable temperature, and filtration.

The present disclosure is also directed to methods for forming the mouthpiece of the aerosol-generating devices. These methods include production steps and parameters that yield the cellulose acetate tow rod having the specified denier per filament and total denier without sacrificing the quality of the cellulose acetate tow or the mouthpiece of the aerosol-generating device.

Beneficially, by using a cellulose acetate tow rod having from >9 to <12.5 denier per filament and from 20,000 to 40,000 total denier, the pressure drop values of the rod are decreased while maintaining high rod strength, leading to improvements in draw while maintaining the desired hardness of the mouthpiece. While conventional cigarette filters typically use cellulose acetate tow having low dpf (e.g., up to 3.5 dpf) and medium total denier (e.g., up to 40,000 total denier), it has surprisingly and unexpectedly been found that cellulose acetate tows having the same total denier but a greater dpf may be used in the mouthpiece of an aerosol-generating device (i.e., a non-conventional cigarette) or as a filter for other types of smoking devices, such as for smoking cannabis. In some aspects, the medium dpf and total denier may be used in conventional cigarettes. When used in the mouthpiece of the aerosol-generating device or in a device for smoking cannabis, rods formed from cellulose acetate tow having from >9 to <12.5 dpf and from 20,000 to 40,000 total denier are able to achieve a low encapsulated pressure drop, which improves the draw characteristics of the aerosol-generating device, while maintaining strength and hardness of the mouthpiece of the aerosol-generating device.

Furthermore, the cellulose acetate tow rod having from >9 to <12.5 denier per filament and from 20,000 to 40,000 total denier beneficially has a low pressure drop coefficient of variation, which is an important cellulose acetate tow market parameter, with higher values unacceptable. Pressure drop (and rod-to-rod pressure drop Cv), as used herein, is measured as follows: using a Quality Test Module (QTM-6) for pressure drop from Cerulean of Richmond, Va., USA with encapsulating tubing—latex, amber 5/16" ID×0.015" wall thickness, 35±5 durometer, calibrated with a certified 1.0 g weight and Cerulean standards for circumference rods and glass, the QTM is set up with air pressure—50 psi, flow rate—targeted for 17.7 cc/sec, encapsulation tubing—5/16" ID×0.015" (157 mm length (8% stretch)) and lf=on, cr=on, stop2=off, parity=off, baud=9600, Pd settle=0, inches=off, Pd=on, shape=off, roundness=off, ova=off, size-laser=on, suspend=off, wt=on, QTM ld=0, auto cal=off, protocal=0 (or 1, if HOST=on), host=off (or on for LIMS or PC connection), sw2 ident=2, sw1 ident=1, batch size=0, cofv=on, statistics=on, results=on, language=GB, printer=on, 30 preconditioned (preconditioning for 48 hours, at 22° C.±2° C., relative humidity-60%±2%) rods are tested and values of pressured drop and Cv are reported. In some aspects, the pressure drop CV is less than 4.0%.

In addition, the cellulose acetate tow having from >9 to <12.5 denier per filament and from 20,000 to 40,000 total denier results in acceptable debaling, i.e., it can be debaled without issues and perform well on rod-makers at speeds of up to 600 M/min. "Debaling" refers to the smoothness of delivery from the bale surface. Typically, mid-range denier per filament and total denier tows cannot meet such performance requirements at conventional tow crimp levels because they have high pressure drop coefficients of variation and debaling issues including picks and pullups. By improving the crimp uniformity of the tow at crimp levels (uncrimping energy, "UCE") much greater than used on conventional tow items having a dpf of less than 9, the pressure drop coefficient of variation was reduced.

Cellulose Acetate

In some embodiments, the present disclosure relates to a cellulose acetate tow processed into filter rods for use, for example, as filters in smoking or aerosol-generating devices, e.g., as the mouthpiece or as a filter in an aerosol-generating device. In some aspects, cellulose acetate refers to cellulose diacetate. In some aspects, the cellulose acetate has a degree of substitution from 2 to 2.6.

Cellulose acetate may be prepared by known processes, including those disclosed in U.S. Pat. No. 2,740,775 and in U.S. Publication No. 2013/0096297, the entireties of which are incorporated herein by reference. Typically, acetylated cellulose is prepared by reacting cellulose with an acetylating agent in the presence of a suitable acidic catalyst and then de-esterifying.

Tow, Tow Band, Bales and Methods of Producing Bales

In some embodiments of the present disclosure, cellulose acetate tow is formed having from greater than 9 to less than 12.5 dpf and from 20,000 to 40,000 total denier. The tow may then be formed into a tow band comprising crimped tow and baled for further use. The tow band may comprise a plurality of cellulose acetate filaments. In some embodiments, a bale may comprise more than one tow band.

In some embodiments, a bale of crimped tow band comprises from greater than 9 to less than 12.5 dpf, e.g., from 9.5 to less than 12.5 dpf, from 10 to less than 12.5 dpf, from 9.5 to 12.3 dpf, from 10 to 12.3 dpf, from 10.5 to 12.3 dpf, from 10.5 to 12.3 dpf, from 11 to 12.3 dpf, from 11 to 12 dpf, or approximately 12 dpf. In terms of dpf, the variability as a percent coefficient of variability (% CV) may be less than 15%, e.g., less than 12%, less than 10%, or less than 8%, less than 6, less than 4, as measured by Favimat Testing Equipment. Favimat is a semiautomatic, microprocessor controlled tensile tester which works according to the principle of constant rate of extension (DIN 51 221, 53 816, ISO 5079 (Textile fibers—Determination of breaking force and elongation at break of individual fibers)) with integrated measuring head for fineness measurement according to the vibroscopic testing principle using constant tensile force and gauge length and variable exiting frequency (ASTM D 1577 (Standard Test Methods for Linear Density of Textile Fibers); BISFA 1985/1989 chapter F). In terms of ranges, the variability may range from 1 to 15%, from 1 to 12%, from 1 to 10%, from 1 to 8%, from 1 to 6%, from 1 to 4%, from 2 to 15%, from 2 to 12%, from 2 to 10%, from 2 to 8%, from 2 to 6%, or from 2 to 4%.

The bale of crimped tow band may have a total denier from 20,000 to 40,000, e.g., from 20,500 to 40,000, from 21,000 to 40,000, from 21,000 to 35,000, from 21,000 to 30,000, from 24,000 to 35,000, from 24,000 to 30,000, or from 25,000 to 28,000. In some embodiments, the crimped tow band comprises a plurality of cellulose acetate filaments.

Generally, the production of a bale of tow bands may involve spinning filaments from a dope, forming a tow band from the filaments, crimping the tow band, and baling the crimped tow band. When spinning filaments, various temperatures for both water and air may be used. In some aspects, the temperatures and temperature profiles may be modified to ensure proper drying time and to ensure proper removal of solvent (e.g., acetone) from within the fiber to obtain proper crisp, distortion free filament cross-sections. Within said production, optional steps may include, but not be limited to, warming the filaments after spinning, applying a finish or additive to the filaments and/or tow band prior to crimping, and conditioning the crimped tow band. The parameters of at least these steps are important for producing bales capable of producing smoking device filters described herein. It should be noted that bales may vary in size and shape as needed for further processing.

The filaments for use in the present disclosure may have any suitable cross-sectional shape, including, but not limited to, circular, substantially circular, crenulated, ovular, substantially ovular, polygonal, substantially polygonal, dogbone, "Y," "X," "K," "C," multi-lobe, and any hybrid thereof. As used herein, the term "multi-lobe" refers to a cross-sectional shape having a point (not necessarily in the center of the cross-section) from which at least two lobes extend (not necessarily evenly spaced or evenly sized). In some aspects, the cross-section is "Y" shaped. The cross-section of the filaments have low distortion, e.g., less than 15%, less than 10%, less than 5%, less than 1%, or free of distortion and should have minimal deformities. The percentage of distortion may be determined by visual inspection of the cross-section of filaments as viewed under a microscope. The cross-section of the filaments should also be uniform. Without being bound by theory, it is believed that by having distortion-free cross-sections, the tow can be processed on high speed rodmaking equipment without fiber damage issues such as broken filaments and fly. Such fiber damage issues can cause frequent rodmaker stoppages and require additional cleaning.

The filaments for use in the present disclosure may be produced by any method known to one skilled in the art. In some embodiments, filaments may be produced by spinning a dope through a spinneret. As used herein, the term "dope" refers to a cellulose acetate solution and/or suspension from which filaments are produced. In some embodiments, a dope may comprise cellulose acetate and solvents. In some embodiments, a dope for use in conjunction with the present disclosure may comprise cellulose acetate, solvents, and additives. It should be noted that additives are further detailed herein.

Some embodiments of the present disclosure may involve treating filaments to achieve surface functionality on the filaments. In some embodiments, filaments may comprise a surface functionality including, but not limited to, biodegradability sites (e.g., defect sites to increase surface area to enhance biodegradability), chemical handles (e.g., carboxylic acid groups for subsequent functionalization), active particle binding sites (e.g., sulfide sites binding gold particles or chelating groups for binding iron oxide particles), sulfur moieties, or any combination thereof. One skilled in the art should understand the plurality of methods and mechanisms to achieve surface functionalities. Some embodiments may involve dipping, spraying, ionizing, functionalizing, acidizing, hydrolyzing, exposing to a plasma, exposing to an ionized gas, or any combination thereof to achieve surface functionalities. Suitable chemicals to impart a surface functionality may be any chemical or collection of chemicals capable of reacting with cellulose acetate including, but not limited to, acids (e.g., sulfuric acid, nitric acid, acetic acid, hydrofluoric acid, hydrochloric acid, and the like), reducing agents (e.g., $LiAlH_4$, $NaBH_4$, $H_2$/Pt, and the like), Grignard reagents (e.g., $CH_3MgBr$, and the like), trans-esterification reagent, amines (e.g., R—$NH_3$ like $CH_3NH_3$), or any combination thereof. Exposure to plasmas and/or ionized gases may react with the surface, produce defects in the surface, or any combination thereof. Said defects may increase the surface area of the filaments which may yield higher loading and/or higher filtration efficacy in the final filter products.

In some embodiments, the present disclosure may include forming tow bands from a plurality of filaments, e.g., cellulose acetate filaments. In some embodiments, a tow band may include the dpf and total denier described herein, e.g., all values from >9 to <12.5 dpf and from 20,000 to 40,000 total denier.

In some embodiments of the present disclosure, a tow band may comprise more than one type of filament. In some embodiments, the more than one type of filament may vary based on dpf, cross-sectional shape, composition, treatment prior to forming the tow band, or any combination thereof. Examples of suitable additional filaments may include, but are not limited to, carbon filaments, activated carbon filaments, natural fibers, synthetic filaments, cellulose acetate filaments with a denier per filament of less than about 9, or any combination thereof.

Some embodiments of the present disclosure may include crimping the tow band to form a crimped tow band. Crimping the tow band may involve using any suitable crimping technique known to those skilled in the art. These techniques may include a variety of apparatuses including, but not limited to, a stuffer box or a gear. Non-limiting examples of crimping apparatuses and the mechanisms by which they work can be found in U.S. Pat. Nos. 7,610,852 and 7,585,441, the relevant disclosures of which are incorporated herein by reference. Suitable stuffer box crimpers may have smooth crimper nip rolls, threaded or grooved crimper nip rolls, textured crimper nip rolls, upper flaps, lower flaps, or any combination thereof.

In some embodiments, the crimp may also be characterized by the uncrimping energy (UCE) and breaking strength (B S). As used herein, "UCE" is the amount of work required to uncrimp a tow band. UCE is the area under the load-elongation curve between defined load limits, per unit length of extended sample (at the upper load limit). The BS is taken at the highest load point of the stress-strain curve and calculated, taking into account the double thickness of the tow. The tow must meet minimum strength requirements so that it can process through a rodmaker without breaking. UCE can be measured either during the process ("process UCE" is UCE measured when the tow is laid down or plaited prior to baling) or from the tow bale ("bale UCE"). Generally, UCE and BS can be measured as follows:

preconditioning the tow band sample (24 hours at 22° C.+/−2° C. with relative humidity at 60%+/−2% for bale testing, within 2 hours 22° C.+/−2° C. with relative humidity at 60%+/−2% for process testing), pre-cutting the tow band sample, warming (about 20 minutes before conventional calibration) Instron tensile tester (Model 1130, crosshead gears—Gear #'s R1940-1 and R940-2, Instron Series IX-Version 6 data acquisition & analysis software, Instron 50 Kg maximum capacity load cell, Instron top roller assembly, 1"×4"×⅛" thick high grade non-slip grip faces), loading the preconditioned tow band sample (about a 76 cm length is looped over and spread evenly across the center of the top roller), pre-tensioning the tow band (gently pulling to 100 g+/−2 g per readout display), clamping each end of the sample in the lower of the non-slip grips to effect a 50 cm gauge length (clamping at the highest available pressure, but not exceeding the manufacturers recommendations) (gauge length measured from top of the non-slip grips), and testing at a crosshead speed of 30 cm/minute until breaking the tow band (Instron, Model 1130).

The average of at least three data points provides UCE as calculated by Formula I:

$$UCE(g\text{-}cm/cm)=(E*1000)/((D*2)+500), \quad \text{Formula I:}$$

where (E) is the energy (g-cm) between load limits of 0.220 kg and 6 kg or 10 kg as required so as to be below the tow breaking strength, (D) is displacement in units of mm at a preset point (6 kg or 10 kg), (2) is a multiplier to adjust for a doubled sample, and (500) is the original gage length (mm). In some aspects, process UCE is measured with an upper load limit and displacement of 10 kg and bale UCE is measured with an upper load limit and displacement of 6 kg.

The breaking strength (BS) can be calculated according to Formula II:

$$BS=L, \quad \text{Formula II:}$$

where (L) is the load measured at maximum load (kg).

The bale UCE may range from a lower limit of about 200 g-cm/cm, 225 g-cm/cm, 250 g-cm/cm, or 260 g-cm/cm to an upper limit of about 400 g-cm/cm, 350 g-cm/cm, 325 g-cm/cm, or 300 g-cm/cm, wherein the UCE may range from any lower limit to any upper limit and encompass any subset there between, Process to bale UCE as tested at the same upper load limit and displacement may be calculated by applying a bias to the process UCE value since it is known that UCE increases from process to bale. The process to bale bias is approximately 20 UCE units. Typically, process UCE is measured in order to control crimping while bale UCE is measured once the tow bale is formed. Process to bale UCE when the process is tested at 10 kg process upper load limit and displacement and the bale is tested at 6 kg upper load limit and displacement is approximately −50 units. In some aspects, the process UCE may range from 270 to 350 g-cm/cm, from 280 to 340 g-cm/cm, or from 290 to 330 g-cm/cm. The bale UCE may range from 200 to 370 g-cm/cm, from 200 to 360 g-cm/cm, from 200 to 350 g-cm/cm or any range or value there between.

Exemplary UCE (process) specifications for 12 dpf, 40,000 total denier range from 290 to 350 g-cm/cm, with a target of 320 g-cm/cm. Exemplary UCE (process) specifications for 12 dpf, 25,000 total denier range from 270 to 350 g-cm/cm, with a target of 300 g-cm/cm. Exemplary UCE (process) specifications for 12 dpf, 28,000 total denier range from 260 to 310 g-cm/cm, with a target of 290 g-cm/cm. The bale UCE specifications may be determined by adding 20 to each value. Thus, Exemplary UCE (bale) specifications for 12 dpf, 40,000 total denier range from 310 to 370 g-cm/cm, with a target of 340 g-cm/cm. Exemplary UCE (bale) specifications for 12 dpf, 25,000 total denier range from 290 to 370 g-cm/cm, with a target of 320 g-cm/cm. Exemplary UCE (bale) specifications for 12 dpf, 28,000 total denier range from 280 to 330 g-cm/cm, with a target of 310 g-cm/cm.

It was surprisingly found that the medium total denier cellulose acetate tow exhibited similar breaking strength and UCE as conventional tow, e.g., tow having a lower dpf.

The configuration of the crimp may play a role in the processability of the final bale. Examples of crimp configurations may include, but not be limited to, lateral, vertical, some degree between lateral and vertical, random, or any combination thereof. As used herein, the term "lateral" when describing crimp orientation refers to crimp or fiber bends in the plane of the tow band. As used herein, the term "vertical" when describing a crimp orientation refers to crimp projecting outside of the plane of the tow band and perpendicular to the plane of the tow band. It should be noted that the terms lateral and vertical refer to general overall crimp orientation and may have deviation from said configuration by ±30 degrees.

In some embodiments of the present disclosure, a crimped tow band may comprise filaments with a first crimp configuration and filaments with a second crimp configuration.

In some embodiments of the present disclosure, a crimped tow band may comprise filaments with at least a vertical crimp configuration near the edges and filaments with at least a lateral crimp configuration near the center. In some embodiments, a crimped tow band may comprise filaments with a lateral crimp configuration near the edges and filaments with a vertical crimp configuration near the center.

The configuration of the crimp may be important for the processability of the final bale in subsequent processing steps, e.g., a lateral crimp configuration may provide better cohesion of filaments than a vertical crimp configuration unless further steps are taken to enhance cohesion. To achieve a lateral crimp, at least one of three processing parameters may be manipulated, e.g., the water content of the tow band prior to crimping, the thickness of the tow band during crimping, and the nip to flap force ratio during crimping.

In some embodiments of the present disclosure, the filaments may be adhered to each other to provide better processability of the final bale. While adhesion additives may be used in conjunction with any crimp configuration, it may be advantageous to use adhesion additives with a vertical crimp configuration. In some embodiments, adhering may involve adhesion additives on and/or in the filaments. Examples of such adhesion additives may include, but not be limited to, binders, adhesives, resins, tackifiers, or any combination thereof. It should be noted that any additive described herein, or otherwise, capable of adhering two filaments together may be used, which may include, but not be limited to, active particles, active compounds, ionic resins, zeolites, nanoparticles, ceramic particles, softening agents, plasticizers, pigments, dyes, flavorants, aromas, controlled release vesicles, surface modification agents, lubricating agents, emulsifiers, vitamins, peroxides, biocides, antifungals, antimicrobials, antistatic agents, flame retardants, antifoaming agents, degradation agents, conductivity modifying agents, stabilizing agents, or any combination thereof. Some embodiments of the present disclosure may involve adding adhesive additives to the filaments (in, on, or both) by incorporating the adhesive additives into the dope, incorporating the adhesive additives into the finish, applying the adhesive additives to the filaments (before, after, and/or during forming the tow band), applying the adhesive additives to the tow band (before, after, and/or during crimping), or any combination thereof. In some aspects, titanium dioxide is present in an amount of greater than 0.01 wt. %, such as from 0.01 wt. % to 1 wt. %. In other aspects, titanium dioxide is present in an amount of 0.01 wt. % or less, such as from 0 to 0.01 wt. %.

Further, some embodiments of the present disclosure may involve heating the filaments before, after, and/or during crimping. While said heating may be used in conjunction with any crimp configuration, it may be advantageous to use said heating with a vertical crimp configuration. Said heating may involve exposing the filaments of the tow band to steam, aerosolized compounds (e.g., plasticizers), liquids, heated fluids, direct heat sources, indirect heat sources, irradiation sources that causes additives in the filaments (e.g., nanoparticles) to produce heat, or any combination thereof.

Some embodiments of the present disclosure may include conditioning the crimped tow band. Conditioning may be used to achieve a crimped tow band having a residual acetone content of 0.5% or less w/w of the crimped tow band. Conditioning may be used to achieve a crimped tow band having a residual water content of 8% or less w/w of the crimped tow band. Conditioning may involve exposing the filaments of the crimped tow band to steam, aerosolized compounds (e.g., plasticizers), liquids, heated fluids, direct heat sources, indirect heat sources, irradiation sources that causes additives in the filaments (e.g., nanoparticles) to produce heat, or any combination thereof.

Some embodiments of the present disclosure may include baling the crimped tow band to produce a bale. In some embodiments, baling may involve placing, e.g., laying, depositing, or arranging, the crimped tow band in a can in a pattern. It should be noted that can is used generically to refer to a container that may be in any shape, preferably square or rectangle, and of any material. As used herein, the term "pattern" refers to any design which may or may not change during placing. In some embodiments of the present disclosure, the pattern may be substantially zig-zag having a periodicity of about 0.5 cycles/ft to about 6 cycles/ft. In some embodiments, placing may involve puddling the crimped tow band with a puddling index of about 10 m/m to about 40 m/m. As used herein, the term "puddling" refers to allowing the tow band to lay at least partially on itself so as to place a greater actual length of tow band than linear distance on which it is placed. As used herein, the term "puddling index" refers to the length of tow band per linear distance on which it is placed.

In some embodiments of the present disclosure, baling may involve compressing the crimped tow band that has been placed in a suitable container.

In some embodiments, the bale includes a crimped tow band having from greater than 9 to less than 12.5 dpf and from 20,000 to 40,000 total denier, the crimped tow band comprising a plurality of cellulose acetate filaments. Some embodiments of the present disclosure may involve placing the crimped tow band from a bale into an apparatus so as to form a filter rod.

Filter Rods

In some embodiments of the present disclosure, a bale of crimped tow band having a medium dpf and total denier (as described above) may be used to form filter rods suitable for use with smoking devices, e.g., conventional cigarettes, devices for smoking cannabis, or aerosol-generating devices. Examples of suitable medium dpf and total denier tow bands may be those according to the various embodiments disclosed herein.

The cellulose acetate filter rod may be a non-wrapped cellulose acetate. The filter rod may have a cross-sectional shape selected from the group comprising circular, substantially circular, crenulated, ovular, substantially ovular, polygonal, substantially polygonal, dog-bone, "Y," "X," "K," "C," multi-lobe, and any combination thereof. In some aspects, the filter rod cross-section is a Y-shaped.

The cellulose acetate tow described herein may be prepared as a filter rod to be used as a cellulose acetate tow filter in a smoking device. The method for forming the filter may include feeding a tow band (crimped or otherwise) having medium dpf and total denier, from a bale into an apparatus capable of producing filter rods. In some embodiments, producing a filter rod may include several steps including, but not limited to, at least one of the following: blooming the crimped tow band into a bloomed tow band; optionally treating the bloomed tow band with an additive; channeling the bloomed tow band yielding a continuous tow cable; wrapping a continuous tow cable with a paper yielding a wrapped tow rod; or alternatively omitting the wrapping step to yield an un-wrapped tow rod; adhering the paper of a wrapped tow rod yielding a filter rod length; cutting the filter rod length into filter rods, filters, and/or filter sections; or any combination thereof. In some embodiments, producing filters and/or filter sections may involve cutting filter rod lengths or filter rods. In some embodiments, producing filter sections may involve cutting filter rod lengths, filter rods, or filters. The filter rod lengths, filter rods, and/or filter sections may have any cross-sectional shape including, but not limited to, circular, substantially circular, ovular, substantially ovular, polygonal (including those with rounded corners), or any hybrid thereof.

Some embodiments of the present disclosure may involve treating the bloomed tow band with additives, at least once. In some embodiments, treating may occur while the bloomed tow band has a large edge-to-edge width and/or while channeling the bloomed tow band. It may be advantageous, but not required, that when the additive is in a particulate form, said treating occurs during channeling. It should be noted that treating may be done by any method including, but not limited to, applying, dipping, immersing, submerging, soaking, rinsing, washing, painting, coating, showering, drizzling, spraying, placing, dusting, sprinkling, affixing, or any combination thereof.

Suitable additives may be those delineated above including, but not limited to, active particles, active compounds, ion exchange resins, zeolites, nanoparticles, ceramic particles, softening agents, plasticizers, pigments, dyes, flavorants, aromas, controlled release vesicles, binders, adhesives, tackifiers, surface modification agents, lubricating agents, emulsifiers, vitamins, peroxides, biocides, antifungals, antimicrobials, antistatic agents, flame retardants, antifoaming agents, degradation agents, conductivity modifying agents, stabilizing agents, and any combination thereof.

In some embodiments of the present disclosure, additives, e.g., active particles and/or active compounds, may be capable of reducing and/or removing a smoke stream component from a smoke stream. One skilled in the art, with the benefit of this disclosure should understand that a smoke stream may be interchanged with a fluid stream for other filter applications. Examples of smoke stream components may include, but not be limited to, acetaldehyde, acetamide, acetone, acrolein, acrylamide, acrylonitrile, aflatoxin B-1,4-aminobiphenyl, 1-aminonaphthalene, 2-aminonaphthalene, ammonia, ammonium salts, anabasine, anatabine, 0-anisidine, arsenic, A-α-C, benz[a]anthracene, benz[b]fluoroanthene, benz[j]aceanthrylene, benz[k]fluoroanthene, benzene, benzo[b]furan, benzo[a]pyrene, benzo[c]phenanthrene, beryllium, 1,3-butadiene, butyraldehyde, cadmium, caffeic acid, carbon monoxide, catechol, chlorinated dioxins/furans, chromium, chrysene, cobalt, coumarin, a cresol, crotonaldehyde, cyclopenta[c,d]pyrene, dibenz(a,h)acridine, dibenz(a,j)acridine, dibenz[a,h]anthracene, dibenzo(c,g)carbazole, dibenzo[a,e]pyrene, dibenzo[a,h]pyrene, dibenzo[a,i]pyrene, dibenzo[a,l]pyrene, 2,6-dimethylaniline, ethyl carbamate (urethane), ethylbenzene, ethylene oxide, eugenol, formaldehyde, furan, glu-P-1, glu-P-2, hydrazine, hydrogen cyanide, hydroquinone, indeno[1,2,3-cd]pyrene, IQ, isoprene, lead, MeA-α-C, mercury, methyl ethyl ketone, 5-methylchrysene, 4-(methylnitrosamino)-1-(3-pyridyl)-1-butanone (NNK), 4-(methylnitrosamino)-1-(3-pyridyl)-1-butanol (NNAL), naphthalene, nickel, nicotine, nitrate, nitric oxide, a nitrogen oxide, nitrite, nitrobenzene, nitromethane, 2-nitropropane, N-nitrosoanabasine (NAB), N-nitrosodiethanolamine (NDELA), N-nitrosodiethylamine, N-nitrosodimethylamine (NDMA), N-nitrosoethylmethylamine, N-nitrosomorpholine (NMOR), N-nitrosonornicotine (NNN), N-nitrosopiperidine (NPIP), N-nitrosopyrrolidine (NPYR), N-nitrososarcosine (NSAR), phenol, PhIP, polonium-210 (radio-isotope), propionaldehyde, propylene oxide, pyridine, quinoline, resorcinol, selenium, styrene, tar, 2-toluidine, toluene, Trp-P-1, Trp-P-2, uranium-235 (radio-isotope), uranium-238 (radio-isotope), vinyl acetate, vinyl chloride, or any combination thereof. In some embodiments of the present disclosure, additives may be capable of reducing and/or removing a component from a fluid stream. Suitable components may include, but not be limited to, dust particulates, pollen, mold, bacteria, ozone, and the like, or any combination thereof.

In some embodiments, when wrapped, suitable papers may include, but not be limited to, tipping papers, plug wrap papers, tipping base papers, wood-based papers, paper containing flax, flax papers, functionalized papers, special marking papers, colorized papers, high porosity papers, corrugated papers, high surface strength papers, or any combination thereof. One skilled in the art, with the benefit of this disclosure, should recognize that the paper may be substituted with any known sheet material. In some embodiments, papers may comprise additives, sizings, printability agents, or any combination thereof. In some embodiments, the filter is a non-wrapped cellulose acetate filter. Some embodiments of the present disclosure may involve adhering the paper of a wrapped tow rod yielding a filter rod length. Adhering may be achieved with any known adhesive capable of adhesively securing the paper wrapped about the tow rod.

Some embodiments of the present disclosure may involve cutting the filter rod length into filter rods and/or filter sections. Cutting may involve any known method and/or apparatus of cutting. The length of a filter rod may range from a lower limit of about 50 mm, 75 mm, or 100 mm to an upper limit of about 150 mm, 140 mm, 130 mm, 120 mm, 110 mm, or 100 mm, and wherein the length may range from any lower limit to any upper limit and encompass any subset there between. The length of a filter may range from a lower limit of about 20 mm, 25 mm, or 30 mm to an upper limit of about 50 mm, 45 mm, or 40 mm, and wherein the length may range from any lower limit to any upper limit and encompass any subset there between. The length of a filter section may range from a lower limit of about 3 mm, 4 mm, or 5 mm to an upper limit of about 15 mm, 14 mm, 13 mm, 12 mm, 11 mm, or 10 mm, and wherein the length may range from any lower limit to any upper limit and encompass any subset there between.

Some embodiments of the present disclosure may involve connecting at least two filter sections. Some embodiments may involve connecting at least two filter sections in fluid communication with each other. Connecting may include, but not be limited to, joining, attaching, combining, associating, coupling, or the like. In some embodiments, connecting may be end-to-end along the longitudinal axis of the filter sections. In some embodiments, connecting at least two filter sections may form a sectioned filter and/or a sectioned filter rod. Some embodiments may involve providing at least two filter sections in respective containers, e.g., hoppers, crates, boxes, drums, bags, or cartons, before connecting. Some embodiments may comprise feeding the at least two filter sections into a row wherein the sections are alternated. Some embodiments may involve wrapping the at least two filter sections with a paper to form a segmented filter and/or a segmented filter rod. Some embodiments may involve transporting the segmented filter and/or the segmented filter rod for storage or use.

In some embodiments, a filter may be a sectioned filter. Some embodiments may involve sectioned filter where at least one first section is a filter section described herein and at least one second filter section may include, but not be limited, cavities, porous masses, polypropylene, polyethylene, polyolefin tow, polypropylene tow, polyethylene terephthalate, polybutylene terephthalate, random oriented acetate, papers, corrugated papers, concentric filters, carbon-on-tow, silica, magnesium silicate, zeolites, molecular sieves, salts, catalysts, sodium chloride, nylon, flavorants, tobacco, capsules, cellulose, cellulosic derivatives, cellulose acetate, catalytic converters, iodine pentoxide, coarse powders, carbon particles, carbon fibers, fibers, glass beads, nanoparticles, void chambers, baffled void chambers, or any combination thereof. It should be noted, that first and second are used for clarity in the description and do not imply any order or positional relationship. In some embodiments, the second filter section may be a cellulose acetate filter section having a different encapsulated pressure drop (EPD) than the first filter section. In some embodiments, the first filter section and the second filter section may be different filter sections described herein, e.g., different additives, different additive concentrations, different EPD, different total denier, different dpf, or any combination thereof.

In some embodiments of the present disclosure, filter rods, filters, filter sections, sectioned filters, and/or sectioned filter rods may comprise at least one cavity. In some embodiments, a cavity may be between two filter sections. The cavity may be filled with a variety of substances including, but not limited to, additives, granulated carbon, flavorants, catalysts, molecular sieves, zeolites, or any combination thereof. The cavity may contain a capsule, e.g., a polymeric capsule, that itself contains a flavorant or catalyst. The cavity, in some embodiments, may also contain a molecular sieve that reacts with selected components in the smoke to remove or reduce the concentration of the components without adversely affecting desirable flavor constituents of the smoke. In some embodiments, the cavity may include tobacco as an additional flavorant. It should be noted that a cavity insufficiently filled with a chosen substance may lack sufficient interaction between the components of the mainstream smoke and the substance in the cavity.

Some embodiments of the present disclosure may involve operably connecting filter rods, filters, filter sections, sectioned filters, and/or sectioned filter rods to a smokeable substance. Some embodiments may involve connecting filter rods, filters, filter sections, sectioned filters, and/or sectioned filter rods to a smokeable substance such that the filter rods, filters, filter sections, sectioned filters, and/or sectioned filter rods are in fluid communication with the smokeable substance.

In some embodiments of the present disclosure, a filter rod, a filter, a filter section, a sectioned filter, and/or a sectioned filter rod may be in fluid communication with a smokeable substance. In some embodiments, a smoking device may comprise a filter rod, a filter, a filter section, a sectioned filter, and/or a sectioned filter rod in fluid communication with a smokeable substance. In some embodiments of the present disclosure, a smoking device may comprise a housing operably capable of maintaining a filter rod, a filter, a filter section, a sectioned filter, and/or a sectioned filter rod in fluid communication with a smokeable substance. In some embodiments, filter rods, filters, filter sections, sectioned filters, and/or sectioned filter rods may be removable, replaceable, and/or disposable from the housing.

In some embodiments, a filter may include a tow having from >9 to <12.5 dpf and from 20,000 total denier to 40,000 total denier, the tow comprising a plurality of cellulose acetate filaments. The filter may have an encapsulated pressure drop of about 2.0 mm water/mm length of filter, e.g., 1.75 mm water/mm length or less, 1.60 mm water/mm length or less, or 1.50 mm water/mm length or less and have a circumference of about 26 mm or less, e.g., from 18 mm to 26 mm. In some embodiments, the filter may have a circumference in a range from 18 mm to 26 mm, e.g., from 21 mm to 25 mm or from 22 mm to 24 mm. In other embodiments, the filter may further comprise additives.

Smoking Device

In some embodiments of the present disclosure, a smoking device may comprise any of the filter rods, filters, filter sections, sectioned filters, and/or sectioned filter rods (collectively "filter components") mentioned above comprising the medium dpf and total denier cellulose acetate. The medium dpf and total denier filter components may be in fluid communication with a smokeable substance. In some embodiments, a smoking device may comprise a housing operably capable of maintaining a filter rod, a filter, a filter section, a sectioned filter, and/or a sectioned filter rod in fluid communication with a smokeable substance. In some embodiments, filter rods, filters, filter sections, sectioned filters, and/or sectioned filter rods may be removable, replaceable, and/or disposable from the housing.

As used herein, the term "smokeable substance" refers to a material capable of producing smoke when burned or heated. Suitable smokeable substances may include, but not be limited to, tobaccos, e.g., bright leaf tobacco, Oriental tobacco, Turkish tobacco, Cavendish tobacco, corojo tobacco, criollo tobacco, Perique tobacco, shade tobacco, white burley tobacco, flue-cured tobacco, Burley tobacco, Maryland tobacco, Virginia tobacco; teas; herbs; carbonized or pyrolyzed components; inorganic filler components; cannabis; or any combination thereof. Tobacco may have the form of tobacco laminae in cut filler form, processed tobacco stems, reconstituted tobacco filler, volume expanded tobacco filler, or the like. Tobacco, and other grown smokeable substances, may be grown in the United States, or may be grown in a jurisdiction outside the United States.

In some embodiments, a smokeable substance may be in a column format, e.g., a tobacco column. As used herein, the term "tobacco column" refers to the blend of tobacco, and optionally other ingredients and flavorants that may be combined to produce a tobacco-based smokeable article, such as a cigarette or cigar. In some embodiments, the tobacco column may comprise ingredients selected from the group consisting of: tobacco, sugar (such as sucrose, brown sugar, invert sugar, or high fructose corn syrup), propylene glycol, glycerol, cocoa, cocoa products, carob 'bean gums, carob bean extracts, and any combination thereof. In still other embodiments, the tobacco column may further comprise flavorants, aromas, menthol, licorice extract, diammonium phosphate, ammonium hydroxide, and any combination thereof. In some embodiments, tobacco columns may comprise additives. In some embodiments, tobacco columns may comprise at least one bendable element.

Suitable housings may include, but not be limited to, cigarette, cigarette holder, cigars, cigar holders, pipes, water pipes, hookahs, electronic smoking devices, roll-your-own cigarettes, roll-your-own cigars, papers, or any combination thereof.

In some embodiments of the present disclosure, filter rods, filters, filter sections, sectioned filters, and/or sectioned filter rods may be degradable over time either naturally or in the presence of a catalyst, e.g., a catalyst pill, coating, or portion of the rod. As used herein, the term "degradable" refers to the ability to decompose when exposed to an outdoor environment (i.e., exposed to rain, dew, or other sources of water). The degree of degradation is, at a minimum, sufficient to convert the cellulose acetate into cellulose and, at a maximum, sufficient to convert the cellulose acetate into glucose. In some embodiments, degradation may occur over at least 1 month, about 6 months or less, about 2 years or less, or about 5 years or less. One skilled in the art with the benefit of this disclosure should understand that the environmental condition, e.g., exposure to light and relative humidity, and the additives, e.g., catalysts, of the filter rods, filters, filter sections, sectioned filters, and/or sectioned filter rods will affect the rate of degradation. In some embodiments of the present disclosure, the filter rods, filters, filter sections, sectioned filters, and/or sectioned filter rods may be recyclable.

Because it is expected that a consumer will smoke a smoking device that includes a filter rod, a filter, a filter section, a sectioned filter, and/or a sectioned filter rod according to any embodiment described herein, the present disclosure also provides methods of smoking such a smoking device. For example, in one embodiment, the present disclosure provides a method of smoking a smoking device comprising: heating or lighting a smoking device to form smoke, the smoking device comprising a filter rod, a filter, a filter section, a sectioned filter, and/or a sectioned filter rod according to any embodiment described herein; and drawing the smoke through the smoking device, wherein the filter rod, the filter, the filter section, the sectioned filter, and/or the sectioned filter rod reduces the presence of at least one component in the smoke stream. In some embodiments, the smoking device is a cigarette. In other embodiments, the smoking device is a cigar, a pipe, a water pipe, a hookah, an electronic smoking device, a smokeless smoking device, a roll-your-own cigarette, a roll-your-own cigar, or another smoking device.

Some embodiments of the present disclosure may include a smoking device that includes a smokeable substance; and a filter comprising a tow having >9 dpf to <12.5 dpf and from 20,000 total denier to 40,000 total denier, the tow comprising a plurality of cellulose acetate filaments. The filter may generally have an encapsulated pressure drop of 2.0 mm water/mm length of filter or less and have a circumference of about 26 mm or less, e.g., 18 mm to 26 mm.

Aerosol-Generating Device

Referring to FIG. 1, an aerosol-generating device is illustrated. In some embodiments, the aerosol-generating device may include, but is not limited to, electronic smoking devices, aerosol-generating devices having a combustible source, smokeless smoking devices, etc. Hereinafter, reference will be made to aerosol-generating devices (unless otherwise specified).

In some embodiments, the present disclosure is directed to aerosol-generating devices comprising a hollow filter, a non-wrapped filter, or combinations thereof. The aerosol-generating device may comprise an outer casing, a reservoir having an aerosol-forming material, a mouthpiece in fluid communication with the reservoir, and a power source/heating means surrounding the reservoir. In some embodiments, the mouthpiece and/or the reservoir may comprise a cellulose acetate filter comprising the cellulose acetate tow described herein.

In one embodiment, the present disclosure relates to aerosol-generating articles that use electrical energy to form an inhalable substance. The aerosol-generating articles can be arranged so as to provide one or more substances (e.g., flavors and/or tobacco) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of this disclosure, the following embodiment is discussed as an example of an aerosol-generating device incorporating a medium total denier cellulose acetate filter. The medium dpf and total denier cellulose acetate filter can be provided be provided in any configuration in the aerosol-generating device, and is not limited to the embodiments discussed below. In some aspects, the use of medium dpf and total denier tow allows for the aerosol-generating device to maintain an aerosol temperature from 250 to 350° C., e.g., from 275 to 325° C., from 285 to 315° C., or from 295 to 305° C.

Aerosol-generating devices are described in greater detail in U.S. Pat. Nos. 4,819,665; 5,499,636; 6,026,820; 8,881,737; 8,910,640; and 9,597,466; and U.S. Pub. Nos. 2005/0172976; 2015/0027474; 2016/0309782; and 2017/0055580; all of which are incorporated herein by reference in their entireties.

FIG. 1 illustrates an aerosol-generating article 10 according to some embodiments. The aerosol-generating article 10 may comprise an outer casing 20, an air passageway 30, a mouthpiece 40, an electric power/heating source 50, and a reservoir 70 comprising aerosol-forming material 80. During use, a user inserts the mouthpiece 40 in his or her mouth, and air flows through the distal end of the aerosol-generating article 10 via the air passageway 30. The aerosol-generating article 10 may produce an aerosol from the aerosol-forming material 80 that may be derived from tobacco as well as other additives.

In some embodiments, the mouthpiece 40 and/or the reservoir 70 including the aerosol-forming material 80 comprise a cellulose acetate filter. In some embodiments, the mouthpiece 40 and/or the reservoir 70 of the aerosol-generating device includes a cellulose acetate filter comprising medium dpf and total denier cellulose acetate. The cellulose acetate filter may comprise a cellulose acetate tow having >9 and <12.5 dpf and from 20,000 to 40,000 total denier. In some embodiments, the mouthpiece 40 and/or the reservoir 70 comprise a cellulose acetate filter. In some aspects, the cellulose acetate filter comprises a hollow cellulose acetate tube having at least 3 dpf and at least 50,000 total denier, or having at least 6 dpf and at least 40,000 total denier. In some embodiments, the cellulose acetate filter is a non-wrapped cellulose acetate.

In some embodiments, the aerosol-forming material 80 is located in a reservoir 70. In the embodiment illustrated in FIG. 1, aerosol-forming material 80 comprises a gathered sheet of crimped homogenized tobacco material. The crimped sheet of homogenized tobacco material may comprise an aerosol-former—such as glycerin.

The aerosol-generating article 10 illustrated in FIG. 1 is designed to engage electric power/heating source 50 in order to form inhalable aerosol. In use, the electric power/heating source 50 of the aerosol-generating article 10 heats the aerosol-forming material 80 to a sufficient temperature to volatilize compounds that are capable of forming an aerosol, which is drawn through the air passageway 30 and inhaled by the user. In use, volatile substances released from the aerosol-forming substrate 80 may optionally pass along an aerosol-cooling element towards the mouthpiece of the aerosol-generating article 10. The volatile substances may cool within the aerosol-cooling element to form an aerosol that is inhaled by the user. In some aspects, the aerosol-cooling element may comprise a cellulose acetate tow having a denier per filament of at least 3 and at least 50,000 total denier, or having a denier per filament of at least 6 and at least 40,000 total denier. In some embodiments, the aerosol-cooling element may comprise a hollow cellulose acetate filter, a non-wrapped cellulose acetate filter, or combinations thereof.

As the aerosol passes downstream thorough the aerosol-cooling element, the temperature of the aerosol can be reduced due to transfer of thermal energy from the aerosol to the aerosol-cooling element. When the aerosol enters the aerosol-cooling element, its temperature is approximately 60° C. Due to cooling within the aerosol-cooling element, the temperature of the aerosol as it exits the aerosol-cooling element is approximately 40° C.

The cellulose acetate tow described herein may be used as an aerosol-cooling element. The aerosol-cooling element refers to a component that cools the aerosol formed by volatile compounds released from the aerosol-forming substrate. The aerosol cooling element is a separate element from the mouthpiece which comprises the cellulose acetate filter, although in some aspects, the cellulose acetate tow having at least 3 dpf and at least 50,000 total denier may be used in both the filter and aerosol-cooling element. The aerosol-cooling element may have a relatively large surface area, e.g., from 300 $mm^2$ to 1000 $mm^2$ per mm length, while still achieving low pressure drop.

The aerosol-cooling element may be formed from a sheet have a thickness from 5 to 500 micrometers, e.g., from 10 to 250 micrometers, which may then be pleated. The aerosol-cooling element may comprise an outer tube or wrapper that contains or locates the longitudinally extending channels. For example, a pleated, gathered, or folded sheet material may be wrapped in a wrapper material, for example a plug wrapper, to form the aerosol-cooling element. In some embodiments, the aerosol-cooling element comprises a sheet of crimped material that is gathered into a rod-shape and bound by a wrapper, for example a wrapper of filter paper. The aerosol-cooling element may be prepared as the filter is prepared, as described above.

In some embodiments, the aerosol-cooling element is formed in the shape of a rod having a length from 7 to 28 mm. For example, an aerosol-cooling element may have a length of 18 mm. In some embodiments, the aerosol-cooling element may have a substantially circular cross-section and a diameter of 5 mm to 10 mm. For example, an aerosol-cooling element may have a diameter of 7 mm.

The cellulose acetate tow may be the sole element of the aerosol-cooling element, or it may be combined with a polylactic acid layer. In some aspects, the weight ratio of polylactic acid to cellulose acetate tow is from 10:1 to 1:10, e.g., from 5:1 to 1:5, from 3:1 to 1:3, from 1:2 to 2:1, or 1:1.

The present disclosure may be further understood in view of the below, non-limiting examples.

EXAMPLES

Example 1: Cross-Section of Tow

Figure 2:
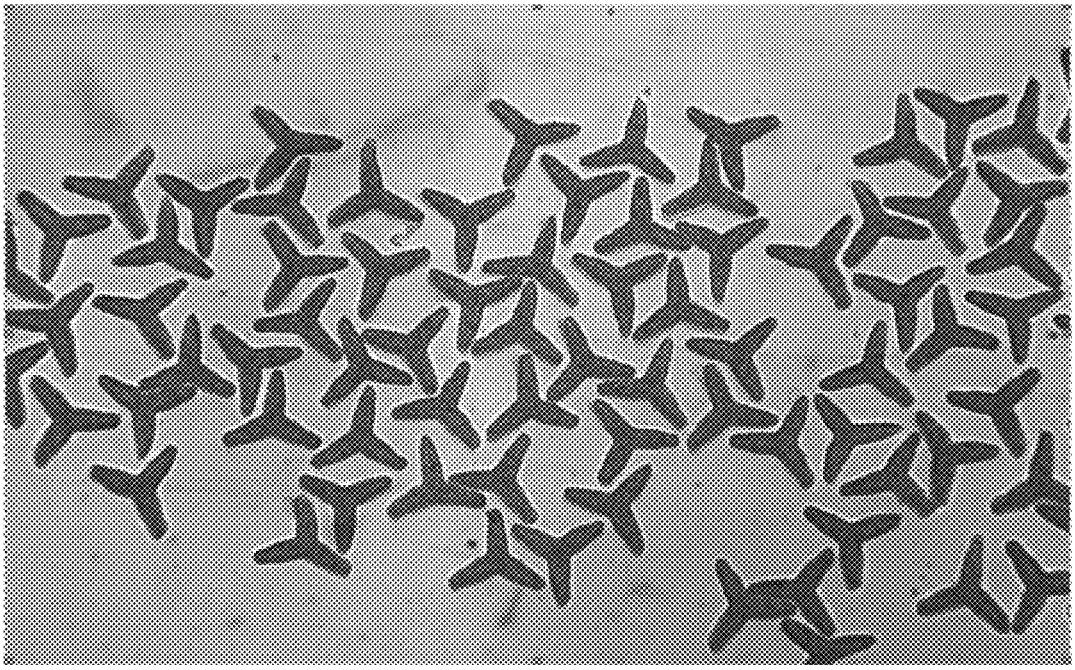
FIG. 2 shows a photograph of the cross-section of cellulose acetate tow in accordance with embodiments of the present invention.

Cellulose acetate tow comprising >9 and <12.5 dpf and from 20,000 to 40,000 total denier was formed using an optimized extrusion process, which optimized spinning machine temperatures and temperature profiles. The cross-section of the tow was photographed using Microtome: Leica RM 2255, Microscope: Leitz Orthoplan Compound Microscope with 160/0.17 objective, Software: Clemex Vision P.E. (Professional Edition) Version: 8.0.153 As shown in FIG. 2, the "Y" cross-section was crisp and well defined. This tow had an acceptable cross-section, had 0% distortion based on a visual inspection of cross-sections of FIG. 2 and had minimal deformities. Additionally, the specific surface area index ("SSAI"=(perimeter/area)×0.5× square root (area/3.14156) was 1.64. The tow had a dpf % coefficient of variation 1.38%, as measured by Favimat (with integrated measuring head for fineness measurement according to the vibroscopic testing principle).

Comparative Example A: Cross-Section of Tow

Figure 3:
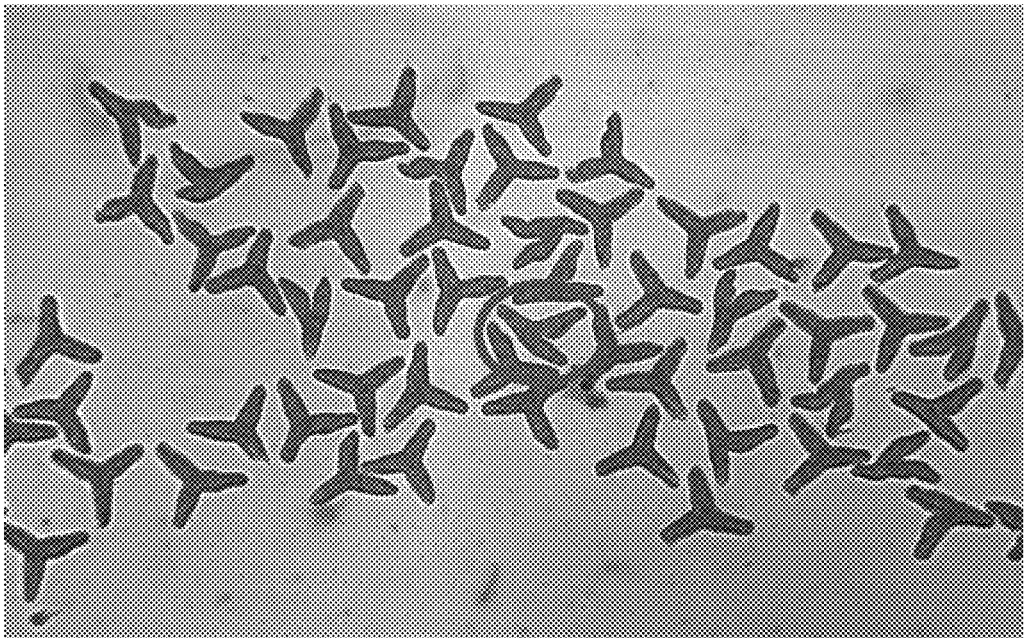
FIG. 3 shows a photograph of the cross-section of cellulose acetate tow of a comparative tow.

Cellulose acetate tow comprising the same dpf and total denier as in Example 1 was formed without adjusting the extrusion process and photographed as described in Example 1. As shown in FIG. 3, the "Y" cross-section was not as crisp or as well defined as in FIG. 2. This tow had an unacceptable cross-section and had >15% distortion based on a visual inspection of the cross-sections shown in FIG. 3. The cross-section also had deformities. An exemplary distorted cross-section is shown as circled in FIG. 3.

Example 2: EPD and Hardness

A cellulose acetate tow formed as in Example 1 had 12 dpf and 40,000 total denier. Thirty rods were formed from the tow. The rods had a mean circumference of 23.67 mm. The encapsulated pressure drop and hardness of the rods were measured according to the methods described here. The mean encapsulated pressure drop per mm length was 1.12 mm water/mm length and the mean hardness was 89.35%. The rods therefore had acceptable encapsulated pressure drop and hardness as compared to a conventional tow made from lower dpf tow.

Comparative Example B: EPD and Hardness

A conventional cellulose acetate tow having 8 dpf and 25,000 total denier was formed. Thirty rods were formed from the tow and the mean circumference was 23.91 mm. The pressure drop and hardness were tested as in Example 2. The mean encapsulated pressure drop was 0.94 mm water/mm length, the mean hardness was 84.36%.

Example 3: Comparison of Process UCE to Bale UCE at the Same Upper Load Limit and Displacement In order to confirm that the process to bale bias is approximately 20 UCE units, the UCE of tow having 12 dpf and 28,000 total denier was measured both during the process of laying the tow and from the bale. The upper load limit was 6 kg. UCE was measured as follows:

I. precondition the tow band sample (24 hours at 22° C.+/−2° C. with relative humidity at 60%+/−2% for bale testing, within 2 hours at 22° C.+/−2° C. with relative humidity at 60%+/−2% for process testing), II. warm (about 20 minutes before conventional calibration) Instron tensile tester (Model 1130, crosshead gears—Gear #'s R1940-1 and R940-2, Instron Series IX-Version 6 data acquisition & analysis software, Instron 50 Kg maximum capacity load cell, Instron top roller assembly, 1"×4"×⅛" thick high grade Buna-N 70 Shore A durometer rubber grip faces), III. load the preconditioned tow band sample (about a 76 cm length is looped over and spread evenly across the center of the top roller), IV. pre-tension the tow band (gently pulling to 100 g+/−2 g per readout display), V. clamp each end of the sample in the lower grips to effect a 50 cm gauge length (clamping at the highest available pressure, but not exceeding the manufacturers recommendations) (gauge length measured from top of the rubber grips), and VI. test at a crosshead speed of 30 cm/minute until breaking the tow band.

When the UCE is measured in the process, it is measured after the tow is laid into a bin when the sample is therefore accessible. The results are shown below in Table 1 and confirm that a bias of approximately 20 units to calculate bale UCE from process UCE is appropriate.

TABLE 1

| Sample | Process UCE (g-cm/cm) | Bale UCE (g-cm/cm) | Difference |
|---|---|---|---|
| A | 231 | 239.8 | 8.8 |
| B | 217 | 239 | 22 |
| C | 227 | 249.5 | 22.5 |
| D | 222 | 253.8 | 31.8 |
| E | 233 | 243 | 10 |
| | | Average Difference: | 19.02 |

Example 4: Comparison of Process UCE to Bale UCE at Different Upper Load Limit and Displacement In order to confirm a bias of −50 units to convert from process UCE measured at 10 kg and bale UCE measured with an upper load limit and displacement of 6 kg, the UCE of tow having 12 dpf and 28,000 total denier was measured both during the process of laying the tow and from the bale. Other than the change in upper load limit and displacement of the bale UCE, the process was the same as in Example 3. The results are shown in Table 2.

TABLE 2

| Sample | Process UCE (g-cm/cm) at 10 kg | Bale UCE (g-cm/cm) at 6 kg | Difference |
|---|---|---|---|
| F | 301 | 242.3 | 58.7 |
| G | 310 | 240.3 | 69.7 |
| H | 297 | 249.5 | 47.5 |
| H | 280 | 253.8 | 26.2 |
| I | 295 | 243 | 52 |
| J | 295 | 249.7 | 45.3 |
| K | 272 | 249.6 | 22.4 |
| L | 300 | 259 | 41 |
| M | 301 | 247.3 | 53.7 |
| N | 300 | 238.8 | 61.2 |
| | | Average Difference: | 47.77 |

Example 5

Figure 4:
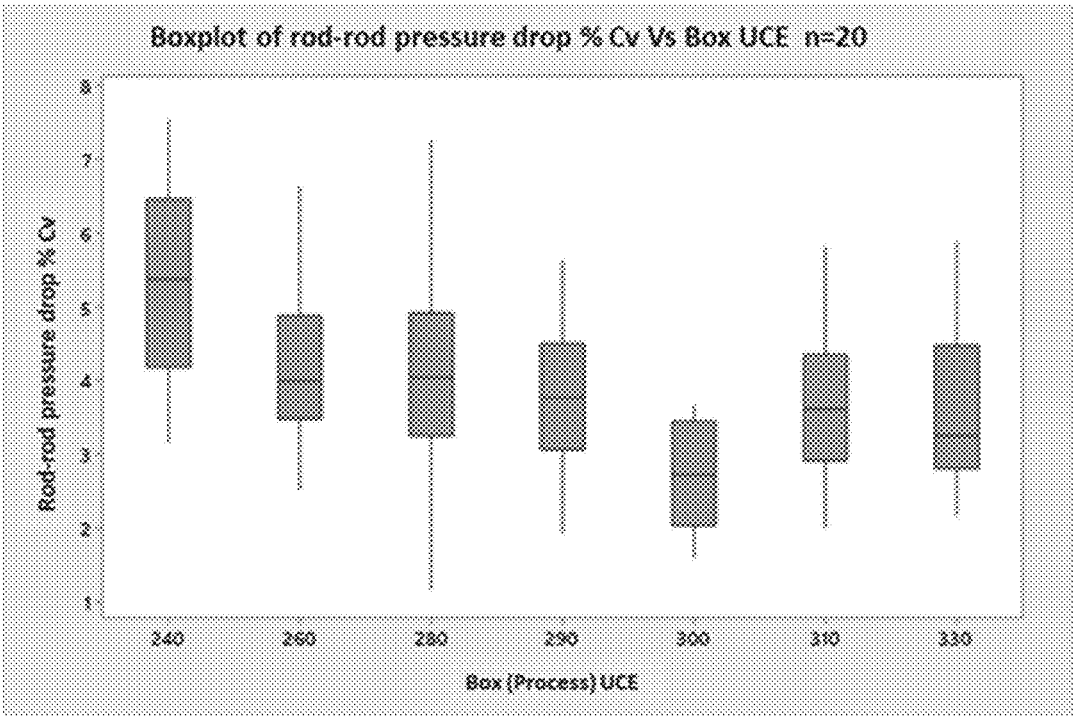
FIG. 4 shows a boxplot of UCE (process) in g-cm/cm in accordance with embodiments of the present invention.

Tows variants were made at significantly higher process UCE levels, ranging from 280 to 330 average target values. The upper load limit was 10 kg and the tow was run on a KDF6 (filter rodmaker) at 600 M/min rodmaking speed. Above 280 UCE (process), pressure drop coefficients of variation ranged from 2.8% to 3.8%. Tow debaling performance improved significantly. Other rodmaking parameters remained acceptable. All other process parameters used to produce the tow remained the same (extrusion settings, speeds, crimper sizing, tow lay parameters, baling settings, etc.). The results are shown in FIG. 4 and report process UCE measured with an upper load limit and displacement at 10 kg.

Comparative Example C

A 12 dpf, 28,000 total denier tow was made within the conventional UCE range of 230-270 UCE (process measured with an upper load limit and displacement at 10 kg). The tow was run on a KDF6 (filter rodmaker) at 600 M/min rodmaking speed. It had high pressure drop coefficients of variation, averaging 5.4% at 240UCE (process) and 4.0% at 260UCE (process). Further the tow de-baled poorly with picking and pull-ups.

Illustrations

Illustration 1: An aerosol-generating device comprising: an aerosol-generating article, wherein the aerosol-generating article comprises: an aerosol-forming substrate; a support element; an aerosol-cooling element; and a mouthpiece, wherein the mouthpiece comprises a cellulose acetate tow rod having from greater than 9 to less than 12.5 denier per filament and from 20,000 to 40,000 total denier.

Illustration 2: The aerosol-generating device of Illustration 1, wherein the cellulose acetate tow rod has an encapsulated pressure drop of 2.0 mm water/mm length or less.

Illustration 3: The aerosol-generating device of any of the preceding illustrations, wherein the cellulose acetate tow rod has a circumference from 18 to 26 mm.

Illustration 4: The aerosol-generating device of any of the preceding illustrations, wherein the aerosol-generating device maintains an aerosol temperature of 250 to 350° C.

Illustration 5: The aerosol-generating device of any of the preceding illustrations, wherein the cellulose acetate tow rod has a hardness of at least 85%.

Illustration 6: The aerosol-generating device of any of the preceding illustrations, wherein the cellulose acetate tow rod has from 24,000 to 35,000 total denier.

Illustration 7: The aerosol-generating device of any of the preceding illustrations, wherein the cellulose acetate tow rod has from 24,000 to 30,000 total denier.

Illustration 8: The aerosol-generating device of any of the preceding illustrations, wherein the cellulose acetate tow rod has from 10 to less than 12.5 denier per filament.

Illustration 9: The aerosol-generating device of any of the preceding illustrations, wherein the cellulose acetate tow rod has from 11.5 to 12.3 denier per filament.

Illustration 10: The aerosol-generating device of any of the preceding illustrations, wherein the cellulose acetate tow rod has approximately 12 denier per filament and from 25,000 to 28,000 total denier.

Illustration 11: The aerosol-generating device of any of the preceding illustrations, wherein filaments of the cellulose acetate tow rod have a cross-sectional shape selected from the group comprising circular, substantially circular, crenulated, ovular, substantially ovular, polygonal, substantially polygonal, dog-bone, "Y," "X," "K," "C," multi-lobe, and any combination thereof.

Illustration 12: The aerosol-generating device of any of the preceding illustrations, wherein the cellulose acetate tow has a denier per filament percent coefficient of variability of less than 15%, less than 12%, less than 10%, most less than 8%, less than 6%, or less than 4%.

Illustration 13: A tow band comprising cellulose acetate tow having from greater than 9 to less than 12.5 denier per filament and from 20,000 to 40,000 total denier.

Illustration 14: The tow band of illustration 13, wherein the cellulose acetate tow rod has from 24,000 to 35,000 total denier.

Illustration 15: The tow band of any of illustrations 13-14, wherein the cellulose acetate tow rod has from 24,000 to 30,000 total denier.

Illustration 16: The tow band of any of illustrations 13-15, wherein the cellulose acetate tow rod has from 10 to less than 12.5 denier per filament.

Illustration 17: The tow band of any of illustrations 13-16, wherein the cellulose acetate tow rod has from 11.5 to 12.3 denier per filament.

Illustration 18: The tow band of any of claims 13-17, wherein the cellulose acetate tow rod has approximately 12 denier per filament and from 25,000 to 28,000 total denier.

Illustration 19: The tow band of any of illustrations 13-18, wherein filaments of the cellulose acetate tow rod have a cross-sectional shape selected from the group comprising circular, substantially circular, crenulated, ovular, substantially ovular, polygonal, substantially polygonal, dog-bone, "Y," "X," "K," "C," multi-lobe, and any combination thereof.

Illustration 20: The tow band of any of illustrations 13-19, wherein the cellulose acetate tow has a denier per filament percent coefficient of variability of less than 15%, less than 12%, less than 10%, less than 8%, less than 6%, or less than 4%.

Illustration 21: A tow bale comprising the tow band of any of illustrations 13-20.

Illustration 22: A method of forming a mouthpiece for an aerosol-generating device, the method comprising: forming a bale from a tow band having from greater than 9 to less than 12.5 denier per filament and from 20,000 to 40,000 total denier, the tow band comprising a plurality of cellulose acetate filaments; debaling and opening the tow band to form a filter tow; forming a mouthpiece comprising a filter rod from the filter tow.

Illustration 23: The method of illustration 22, wherein the cellulose acetate tow rod has an encapsulated pressure drop of 2.0 mm water/mm length or less.

Illustration 24: The method of any of illustrations 22-23, wherein the cellulose acetate tow rod has a circumference from 18 to 26 mm.

Illustration 25: The method of any of illustrations 22-24, wherein the aerosol-generating device maintains an aerosol temperature of 250 to 350° C.

Illustration 26: The method of any of illustrations 22-25, wherein the cellulose acetate tow rod has a hardness of at least 85%.

Illustration 27: The aerosol-generating device of any of the preceding illustrations, wherein the cellulose acetate tow rod has from 24,000 to 35,000 total denier.

Illustration 28: The method of any of illustrations 22-27, wherein the cellulose acetate tow rod has from 24,000 to 30,000 total denier.

Illustration 29: The method of any of illustrations 22-28, wherein the cellulose acetate tow rod has from 10 to less than 12.5 denier per filament.

Illustration 30: The method of any of illustrations 22-29, wherein the cellulose acetate tow rod has from 11.5 to 12.3 denier per filament.

Illustration 31: The method of any of illustrations 22-30, wherein the cellulose acetate tow rod has approximately 12 denier per filament and from 25,000 to 28,000 total denier.

Illustration 32: The method of any of illustrations 22-31, wherein filaments of the cellulose acetate tow rod have a cross-sectional shape selected from the group comprising circular, substantially circular, crenulated, ovular, substantially ovular, polygonal, substantially polygonal, dog-bone, "Y," "X," "K," "C," multi-lobe, and any combination thereof.

Illustration 33: The method of any of illustrations 22-32, wherein the cellulose acetate tow has a denier per filament percent coefficient of variability of less than 15%, less than 12%, less than 10%, less than 8%, less than 6%, or less than 4%.

Illustration 34: The aerosol-generating device of any of illustrations 1-12, wherein the cellulose acetate tow has a bale UCE from 200 g-cm/cm to 370 g-cm/cm.

Illustration 35: The tow band of any of illustrations 13-20, wherein the cellulose acetate tow has a bale UCE from 200 g-cm/cm to 370 g-cm/cm.

While the invention has been described in detail, modifications within the spirit and scope of the invention will be readily apparent to those of skill in the art. It should be understood that aspects of the invention and portions of various embodiments and various features recited above and/or in the appended claims may be combined or interchanged either in whole or in part. In the foregoing descriptions of the various embodiments, those embodiments which refer to another embodiment may be appropriately combined with other embodiments as will be appreciated by one of ordinary skill in the art. Furthermore, those of ordinary skill in the art will appreciate that the foregoing description is by way of example only, and is not intended to limit the invention. All US patents and publications cited herein are incorporated by reference in their entirety.

We claim:

1. An aerosol-generating device comprising:

an aerosol-generating article, wherein the aerosol-generating article comprises:

an aerosol-forming substrate;

a support element;

an aerosol-cooling element;

a mouthpiece, wherein the mouthpiece comprises a cellulose acetate tow rod having from greater than 9 to less than 12.5 denier per filament and from 20,000 to 40,000 total denier; and wherein the cellulose acetate tow rod has a hardness of at least 85%.

2. The aerosol-generating device of claim 1, wherein the cellulose acetate tow rod has an encapsulated pressure drop of 2.0 mm water/mm length or less.

3. The aerosol-generating device of claim 1, wherein the cellulose acetate tow rod has a circumference from 18 to 26 mm.

4. The aerosol-generating device of claim 1, wherein the aerosol-generating device maintains an aerosol temperature of 250 to 350° C.

5. The aerosol-generating device of claim 1, wherein the cellulose acetate tow rod has from 24,000 to 35,000 total denier.

6. The aerosol-generating device of claim 1, wherein the cellulose acetate tow rod has from 24,000 to 30,000 total denier.

7. The aerosol-generating device of claim 1, wherein the cellulose acetate tow rod has from 10 to less than 12.5 denier per filament.

8. The aerosol-generating device of any of the preceding claims, wherein the cellulose acetate tow has a bale UCE from 200 g-cm/cm to 370 g-cm/cm.

9. The aerosol-generating device of any of the preceding claims, wherein filaments of the cellulose acetate tow rod have a cross-sectional shape selected from the group comprising circular, substantially circular, crenulated, ovular, substantially ovular, polygonal, substantially polygonal, dog-bone, "Y," "X," "K," "C," multi-lobe, and any combination thereof.

10. The aerosol-generating device of claim 1, wherein the cellulose acetate tow has a denier per filament percent coefficient of variability of less than 10%.

11. A tow bale comprising a tow band, wherein the tow band comprises cellulose acetate tow having from greater than 9 to less than 12.5 denier per filament and from 20,000 to 40,000 total denier and wherein the tow bale has a process UCE from 280 g-cm/cm to 330 g-cm/cm.

12. The tow bale of claim 11, wherein the cellulose acetate tow rod has from 24,000 to 35,000 total denier.

13. The tow bale of claim 11, wherein the cellulose acetate tow rod has from 24,000 to 30,000 total denier.

14. The tow bale of any of claim 11, wherein the cellulose acetate tow rod has from 10 to less than 12.5 denier per filament.

15. The tow bale of claim 11, wherein filaments of the cellulose acetate tow rod have a cross-sectional shape selected from the group comprising circular, substantially circular, crenulated, ovular, substantially ovular, polygonal, substantially polygonal, dog-bone, "Y," "X," "K," "C," multi-lobe, and any combination thereof.

16. The tow bale band of claim 12, wherein the cellulose acetate tow has a denier per filament percent coefficient of variability of less than 10%.

* * * * *